US007387332B2

(12) United States Patent
Piretti

(10) Patent No.: US 7,387,332 B2
(45) Date of Patent: Jun. 17, 2008

(54) CHAIR CONVERTIBLE INTO CHAISE-LONGUE

(75) Inventor: Alessandro Piretti, Bologna (IT)

(73) Assignee: Pro-Cord SpA, Bologna (IT)

( * ) Notice: Subject to any disclaimer, the term of this patent is extended or adjusted under 35 U.S.C. 154(b) by 93 days.

(21) Appl. No.: 11/423,549

(22) Filed: Jun. 12, 2006

(65) Prior Publication Data

US 2006/0284453 A1 Dec. 21, 2006

(30) Foreign Application Priority Data

Jun. 17, 2005 (EP) ..... 05425438

(51) Int. Cl.
*A47C 13/00* (2006.01)

(52) U.S. Cl. ..... 297/1; 297/3; 297/92; 297/118

(58) Field of Classification Search ..... 297/1, 297/3, 92, 118

See application file for complete search history.

(56) References Cited

U.S. PATENT DOCUMENTS

| | | | | |
|---|---|---|---|---|
| 191,733 | A * | 6/1877 | True | 297/1 |
| 321,230 | A * | 6/1885 | Lewis | 297/93 |
| 2,104,666 | A * | 1/1938 | Molnar | 297/118 |
| 2,674,302 | A * | 4/1954 | McMorran, Jr. et al. | 297/1 |
| 4,525,009 | A | 6/1985 | de la Sota Martinez | |
| 4,580,834 | A * | 4/1986 | de la Sota Martinez | 297/130 |

FOREIGN PATENT DOCUMENTS

| | | |
|---|---|---|
| FR | 2 818 103 | 6/2002 |
| GB | 485263 | 5/1938 |
| WO | WO 88/04903 | 7/1988 |

OTHER PUBLICATIONS

European Search Report, Application No. EP 05425438, dated Feb. 14, 2006.

* cited by examiner

*Primary Examiner*—Sarah B McPartlin
(74) *Attorney, Agent, or Firm*—Patterson & Sheridan, L.L.P.

(57) ABSTRACT

Chair convertible into chaise-longue, comprising a stationary base structure, a first support section fixed relative to the base structure, a second support structure movable relative to the base structure and able to be moved from a substantially horizontal position to an inclined position in which the second support section forms an upward extension of the first support section, and a movable support element having a third and a fourth support section, fixed relative to each other and mutually inclined. The movable support element is movable relative to the base structure between a first and a second position. In the first position, the third support section is parallel and opposite to the first support section and the fourth support section extends upwards starting from the third support section. In the second position, the third support section is inclined relative to the first support section and extends upwards starting from a lower end of the first support section and the fourth support section extends downwards starting from an upper end of the third support section.

17 Claims, 21 Drawing Sheets

CHAIR CONVERTIBLE INTO CHAISE-LONGUE

CROSS-REFERENCE TO RELATED APPLICATIONS

This application claims benefit of European patent application number 05425438.8, filed Jun. 17, 2005, which is herein incorporated by reference.

BACKGROUND OF THE INVENTION

1. Field of the Invention

The present invention relates to a chair convertible into chaise-longue. A chaise-longue is an armchair with anatomical shape that enables the user to assume a semi-reclined position.

2. Description of the Related Art

A chaise-longue is traditionally formed by three portions with different inclinations: a backrest portion, an intermediate portion and a footrest portion. When the user is seated on a chaise-longue, his/her knees are usually at a greater height than his/her hips and feet.

SUMMARY OF THE INVENTION

The object of the present invention is to provide a chair that can be converted into a chaise-longue, and vice versa, with a few simple operations.

According to the present invention, said object is achieved by a chair having the characteristics set out in the claims.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
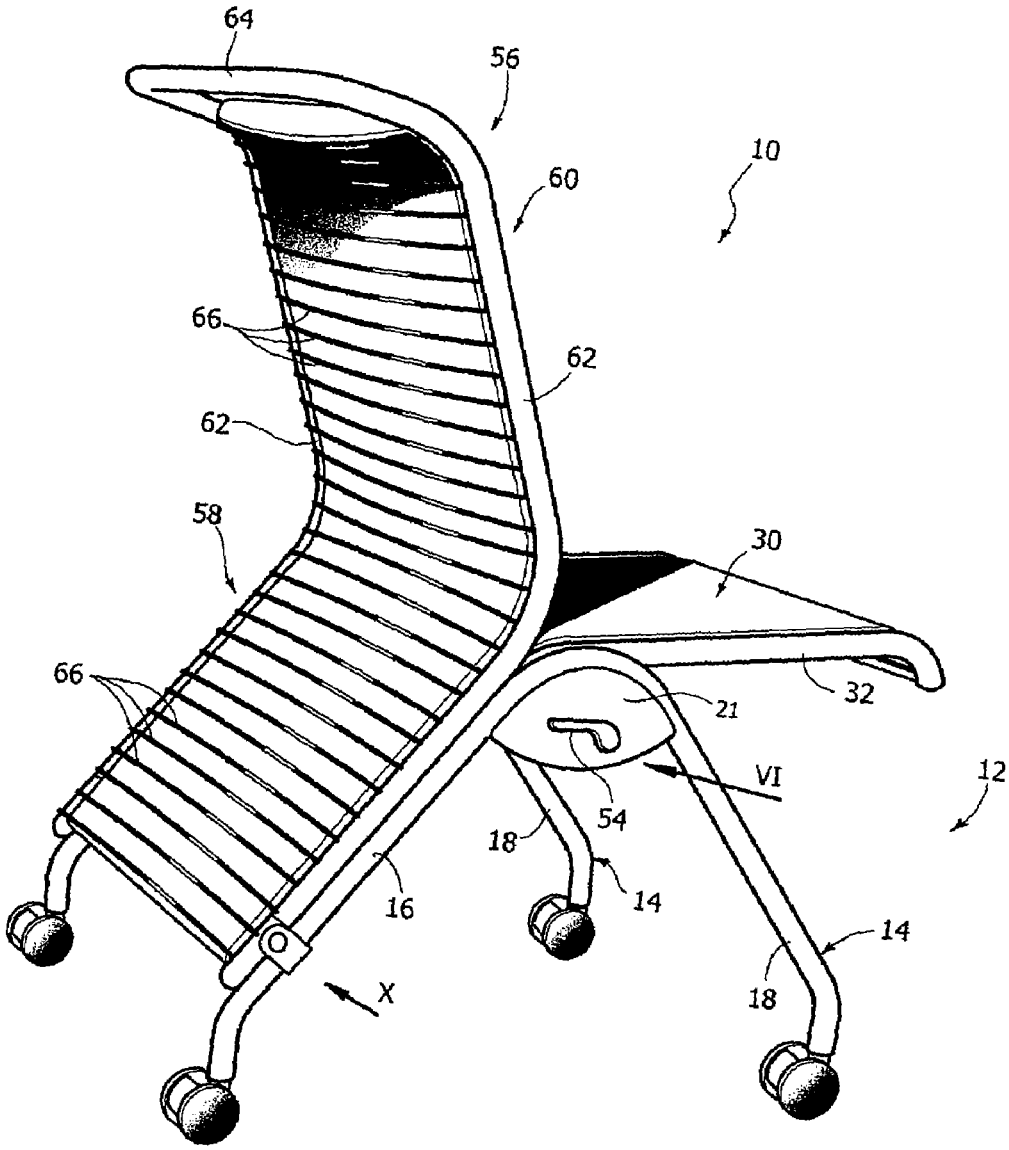
FIGS. 1 and 2 are perspective views of a convertible chair according to the present invention respectively in the chair and chaise-longue configuration.
Figure 2:
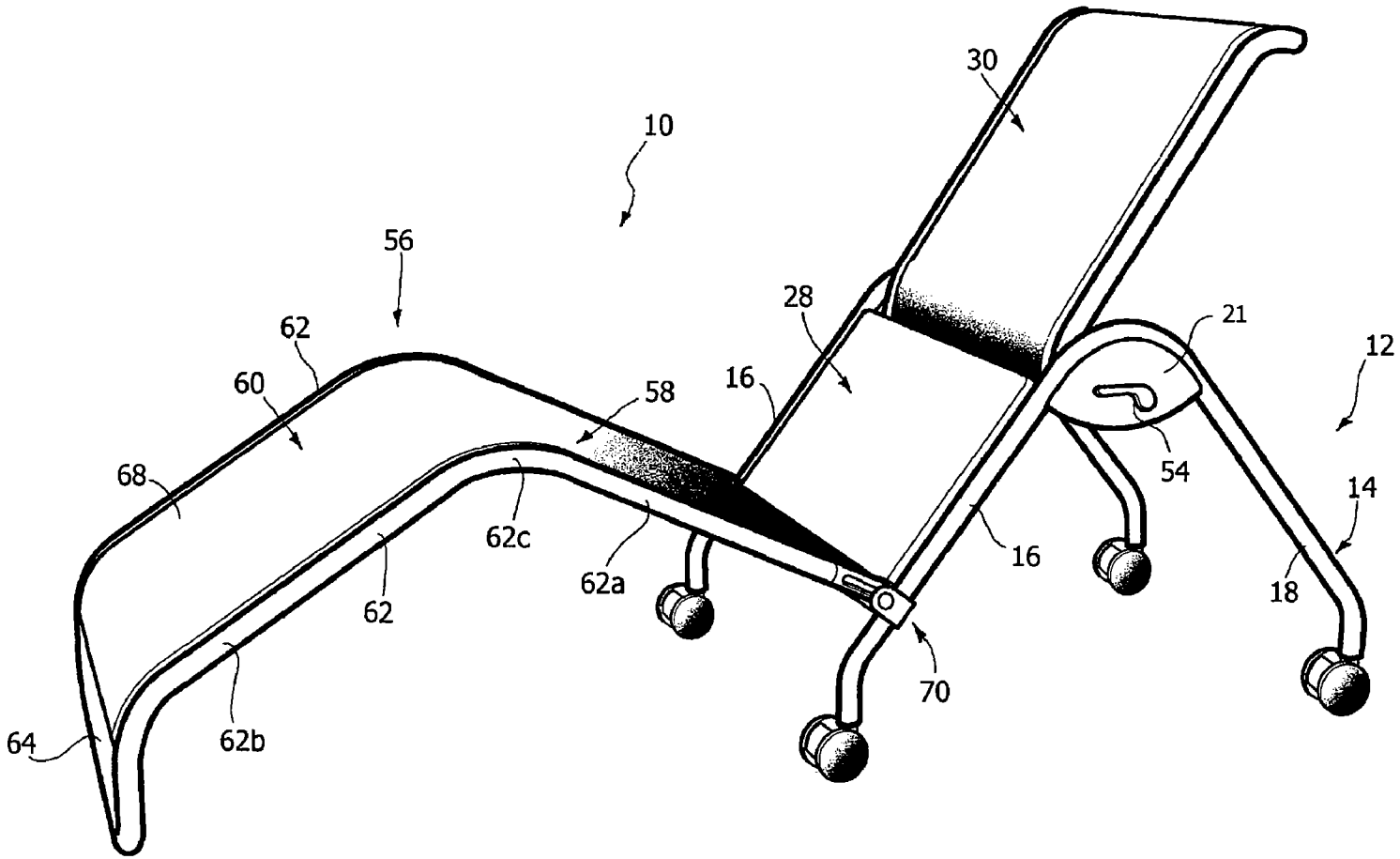

With reference to the drawings, the number 10 designates a convertible chair according to the present invention. FIG. 1 shows the convertible chair in the chair configuration and FIG. 2 shows the same chair in the chaise-longue configuration.

The chair 10 comprises a stationary base structure 12 including, on each side of the chair, a metallic tubular element 14 with substantially inverse V shape with two inclined branches 16, 18 which, in the chair configuration, respectively constitute a rear leg and a front leg.

Figure 9:
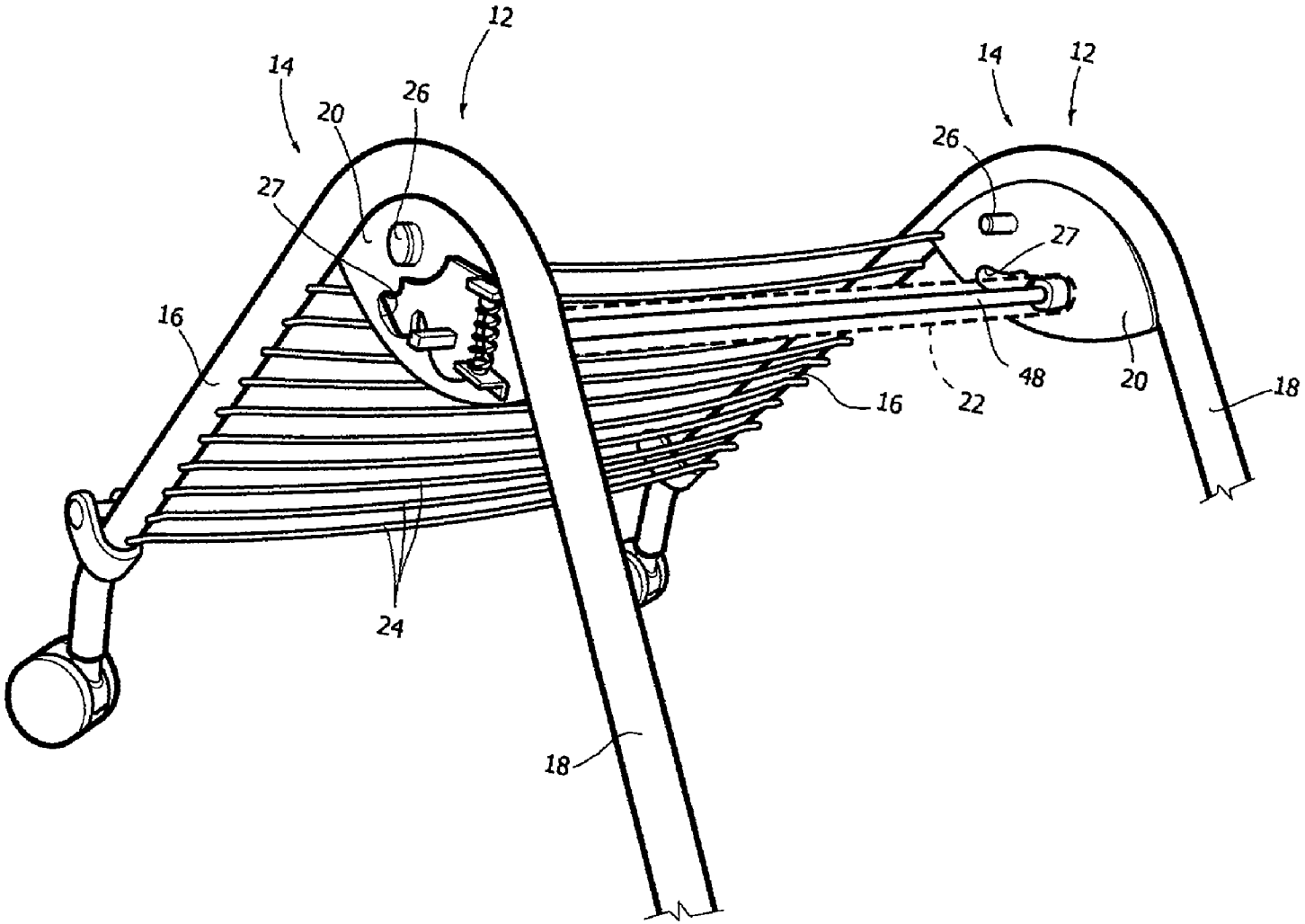
FIG. 9 is a perspective view showing only the base structure of the chair.

FIG. 9 shows only the stationary base structure 12 of the convertible chair according to the present invention. It is readily apparent that each of the two inverse V shaped tubular elements 14 bears, at its upper end, a metallic plate 20 fastened, e.g. by means of welding, to the respective tubular element 14. The plates 20 of the two tubular elements 14 are fastened to each other by means of a transverse tubular member 22. The two segments 16 of the two tubular elements 14 are fastened to each other by means of a plurality of thin transverse metallic rods 24, mutually parallel, whose ends are fastened, e.g. by welding, to the branches 16 of the tubular elements 14.

With reference again to FIG. 9, to each plate 20 is fastened a respective articulation pin 26. The two articulation pins 26 are mutually coaxial and define a transverse articulation axis. Each plate 20 is also provide with an arched groove 27 with its centre on the transverse axis defined by the pins 26. A covering element 21 is fastened to the outer side of each plate 20.

With reference to FIG. 2, the convertible chair 10 comprises a first support section 28, fixed relative to the base structure 12. The first support section 28 can, for example, be constituted by a soft panel, by a stuffed cushion or by a layer of soft material. The first support section 28 can for example be fastened to the transverse metal rods 24 that mutually join the branches 16 of the tubular elements 14. The metal rods 24 constitute the framework of the first support section 28. Alternatively, the first support section 28 could have its own framework, independent of the support structure 12 and fastened thereto. The metal rods 24 preferably have an arched shape in order to define a support surface with a slightly concave shape.

Figure 3:
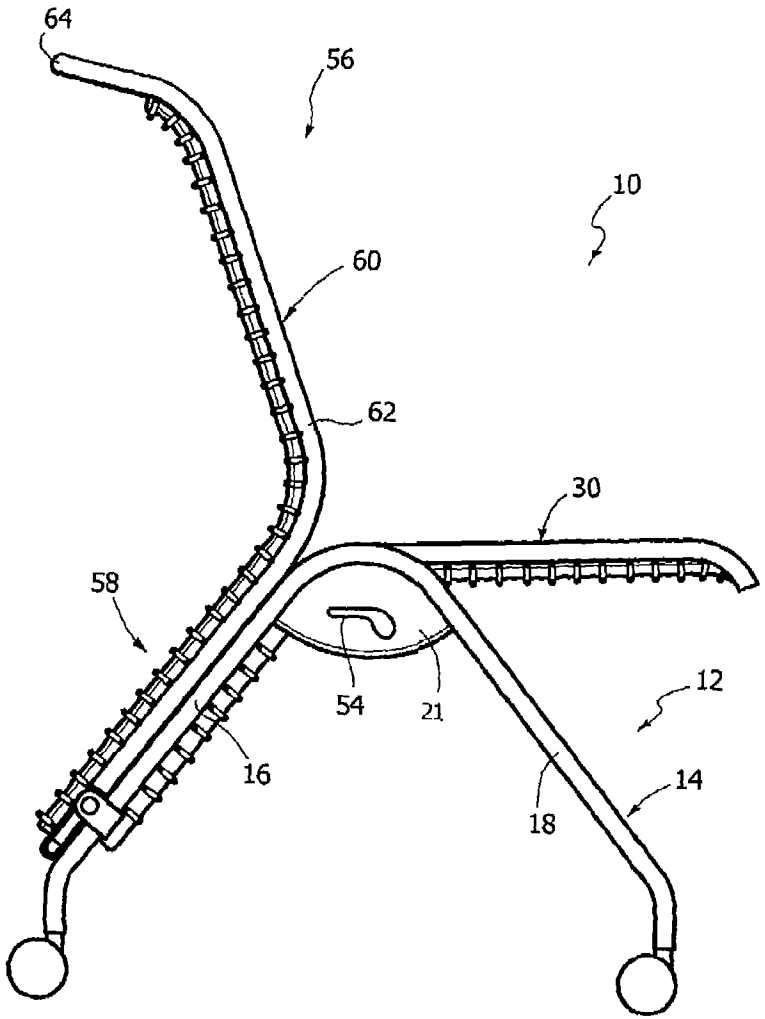
FIGS. 3, 4 and 5 are lateral views illustrating the sequence of conversion of the chair into chaise-longue.
Figure 5:
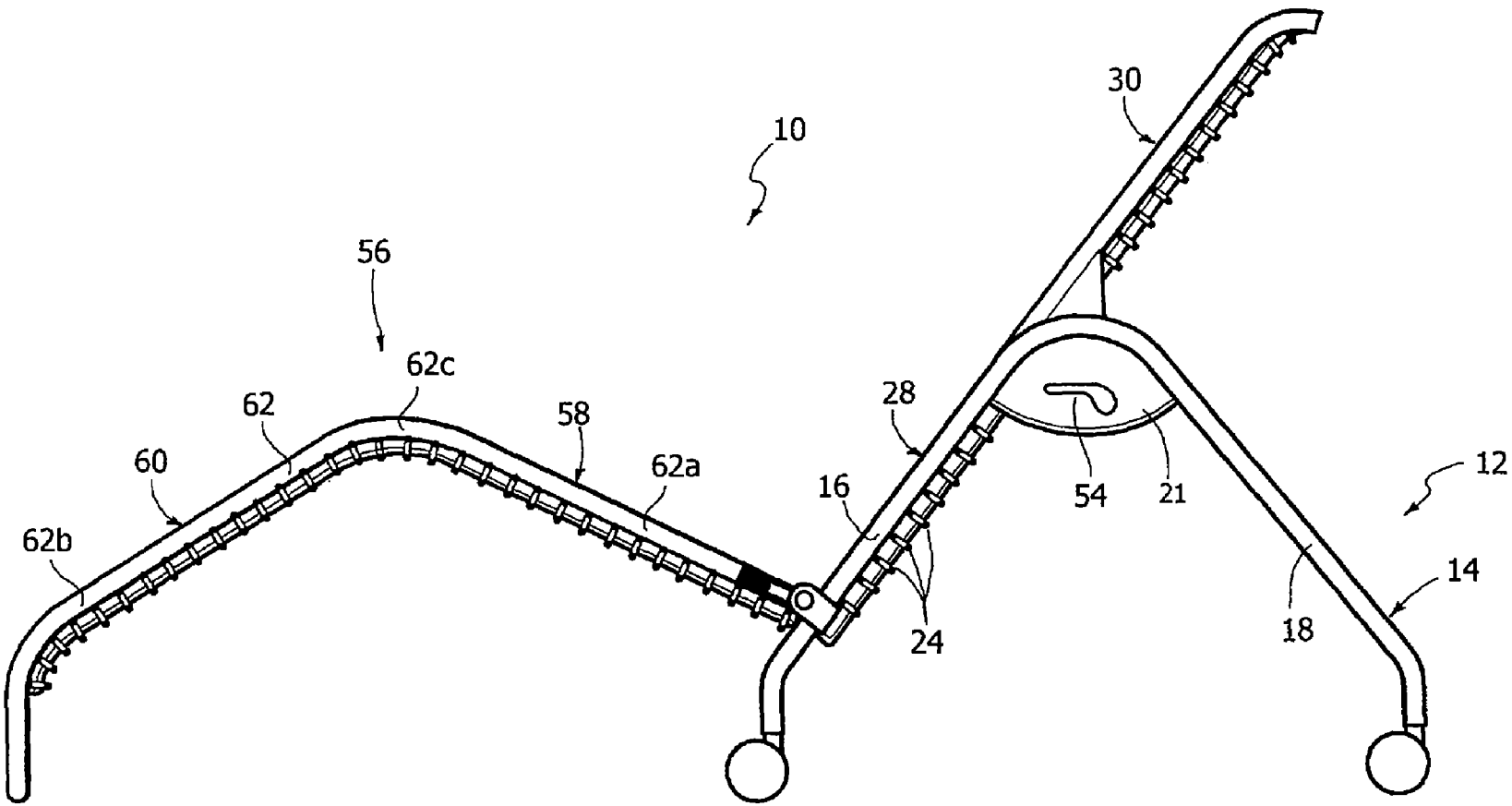
Figure 7:
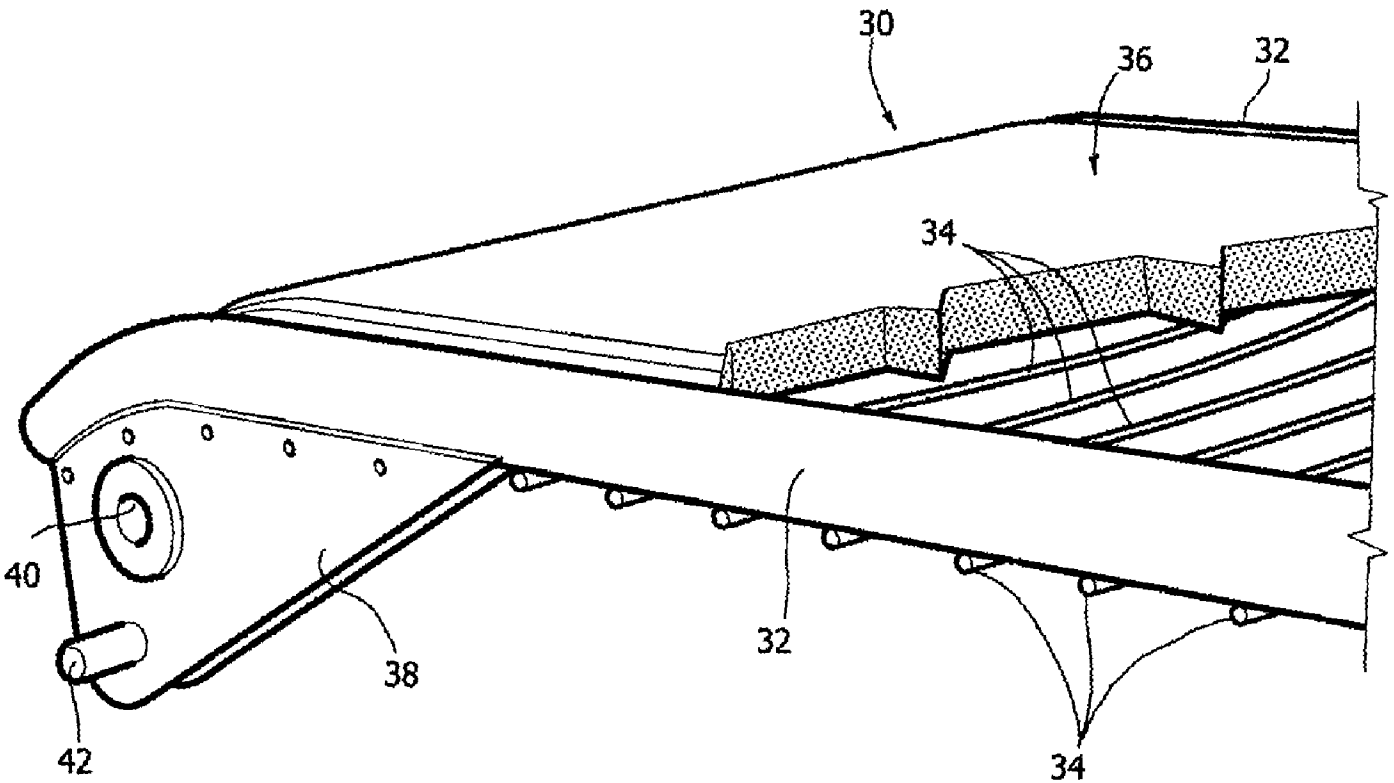
FIG. 7 is a perspective view of the part indicated by the arrow VII in FIG. 6.
Figure 8:
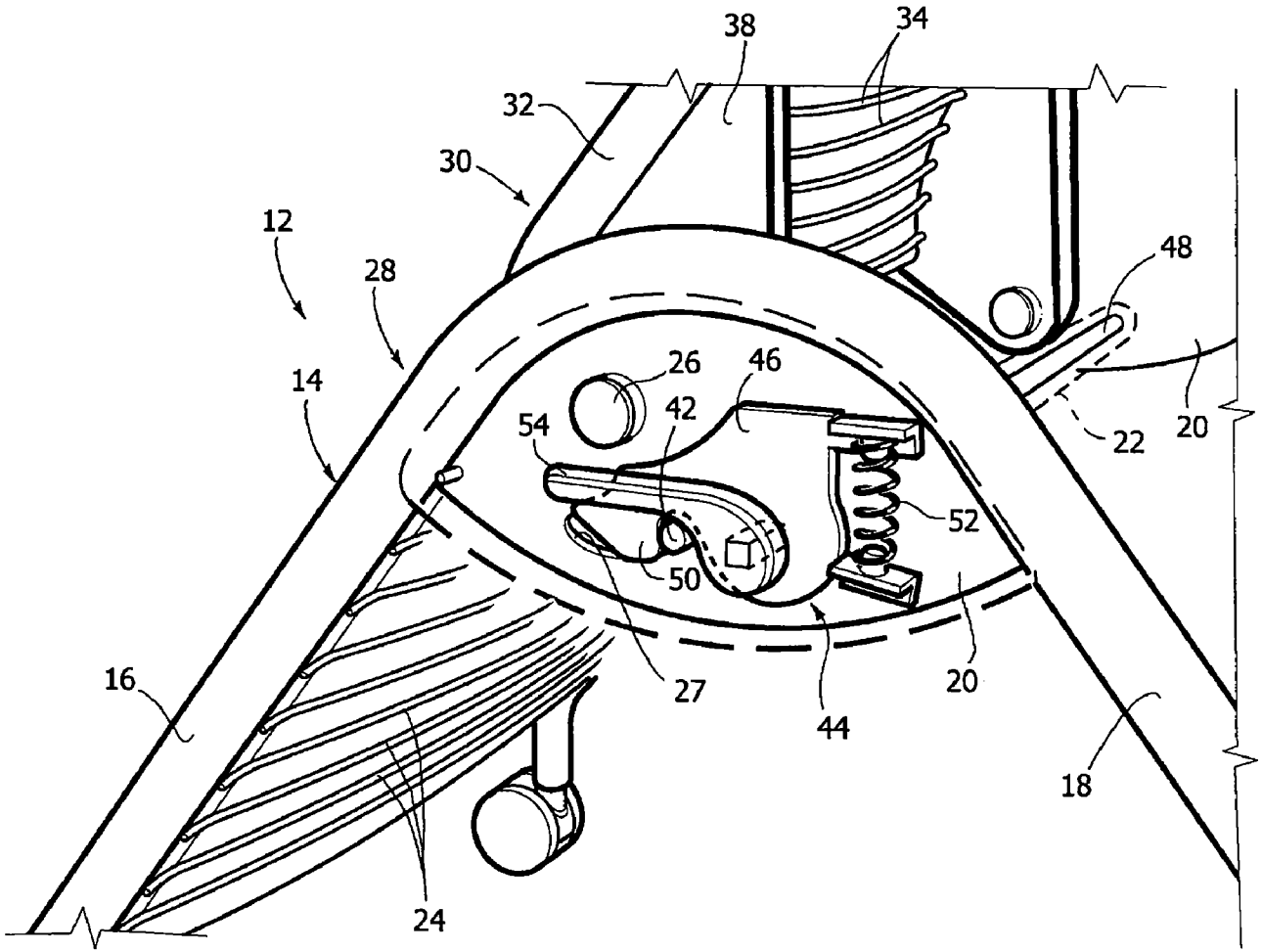
FIG. 8 is a perspective view showing the detail of FIG. 6 in the position corresponding to that of FIG. 2.

The convertible chair 10 comprises a second support section 30 articulated to the base structure 12 and movable between a substantially horizontal position shown in FIGS. 1 and 3 and an inclined position shown in FIGS. 2 and 5. In the horizontal position, the second support section 30 constitutes the seat of the chair whilst in the inclined position the second support section 30 forms an upward extension of the first support section 28. As shown in FIG. 7, the second support section 30 comprises a frame including two lateral tubular elements 32 and a framework formed by a plurality of metal rods 34 fastened at their ends to the lateral tubular elements 32. The support section 30 further comprises a soft layer 36 fastened to the metal rods 34. The metal rods 34 preferably have an arched shape to form a concave support structure. To each lateral tubular element 32 is fastened a flange 38 having an articulation hole 40 and an arresting pin 42. With reference to FIGS. 7, 8 and 9, the articulation pins 26 of the base structure 12 are inserted into the holes 40 of the second support structure 30. The arresting pins 42 of the second support section 30 are inserted in the arched grooves 27. The ends of the grooves 27 define end stop positions corresponding to the lowered and raised position of the second support section 30.

Figure 6:
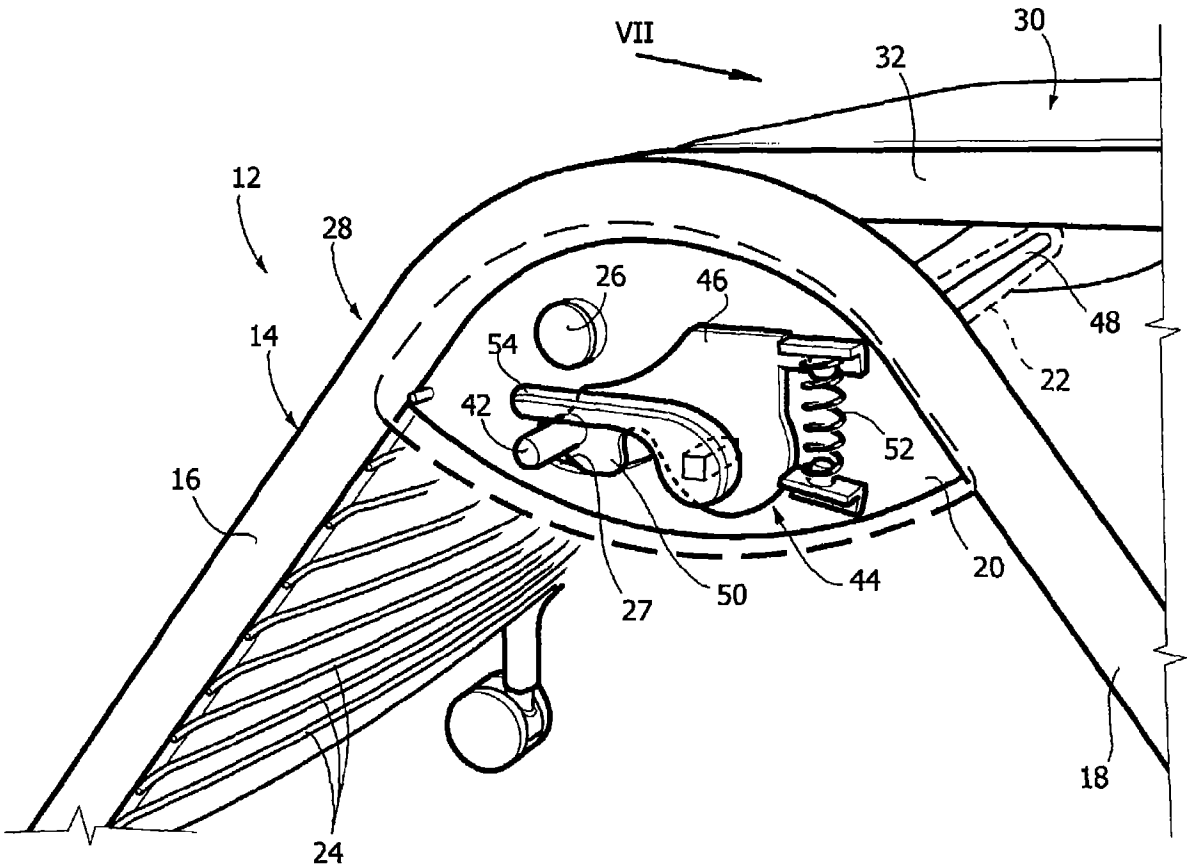
FIG. 6 is an enlarged scale perspective view of the part indicated by the arrow VI in FIG. 1.

With reference to FIGS. 6 and 8, the stationary base structure 12 bears a locking device to arrest the second support section 30 in its raised position (position shown in FIGS. 2 and 5). The locking device 44 comprises two arresting elements 46, each of which is positioned on the outer side of a respective plate 20. The two arresting elements 46 are fastened to each other by means of a transverse rod 48 that extends inside the transverse tubular element 22. Each arresting element 46 has a hook shaped portion 50 which co-operates with the movable arresting pin 42 in the arched groove 27. A helical spring 52 or similar elastic element tends to thrust the arresting element 46 into a locked position. An unlocking lever 54 is fastened to each end of the transverse rod 48 on the outer side of the plate 20. The levers 54 are located outside the respective covering elements 21.

Comparing FIGS. 6 and 8, when the second support section 30 is brought from the lowered position of FIG. 6 to the raised position of FIG. 8, the arresting pins 42, integral relative to the second bearing section 30, move along the grooves 27 and cause the arresting elements 46 to oscillate against the action of the springs 52. When the second support section 30 reaches the raised position, the arresting elements 46 snap to the locked position under the action of the springs 52. To lower the second support section 30, it is sufficient to raise either of the two unlocking levers 54 in order to disengage both hook portions 50 from the pins 42. After this disengagement, the second support section 30 is free to rotate around the axis defined by the pins 26 to return to its lowered position.

With reference to FIGS. 1 through 5, the convertible chair according to the present invention comprises a movable support element 56 having a third and a fourth support section 58, 60, fixed relative to each other and mutually inclined.

The movable support element 56 comprises a tubular peripheral frame formed by two lateral segments 62 joined by a transverse segment 64. The peripheral frame of the movable support element 56 can be formed by a single bent tubular element. Each of the lateral branches 62 has two rectilinear segments 62*a*, 62*b* mutually inclined and joined by an arched segment 62*c*. The lateral branches 62 of the movable support element 56 are joined together by thin transverse metal rods 66, preferably with arched shape, that form the frameworks of the support sections 58, 60. The movable support element 56 comprises a soft layer 68 fastened, for example, to the transverse rods 66.

Figure 10:
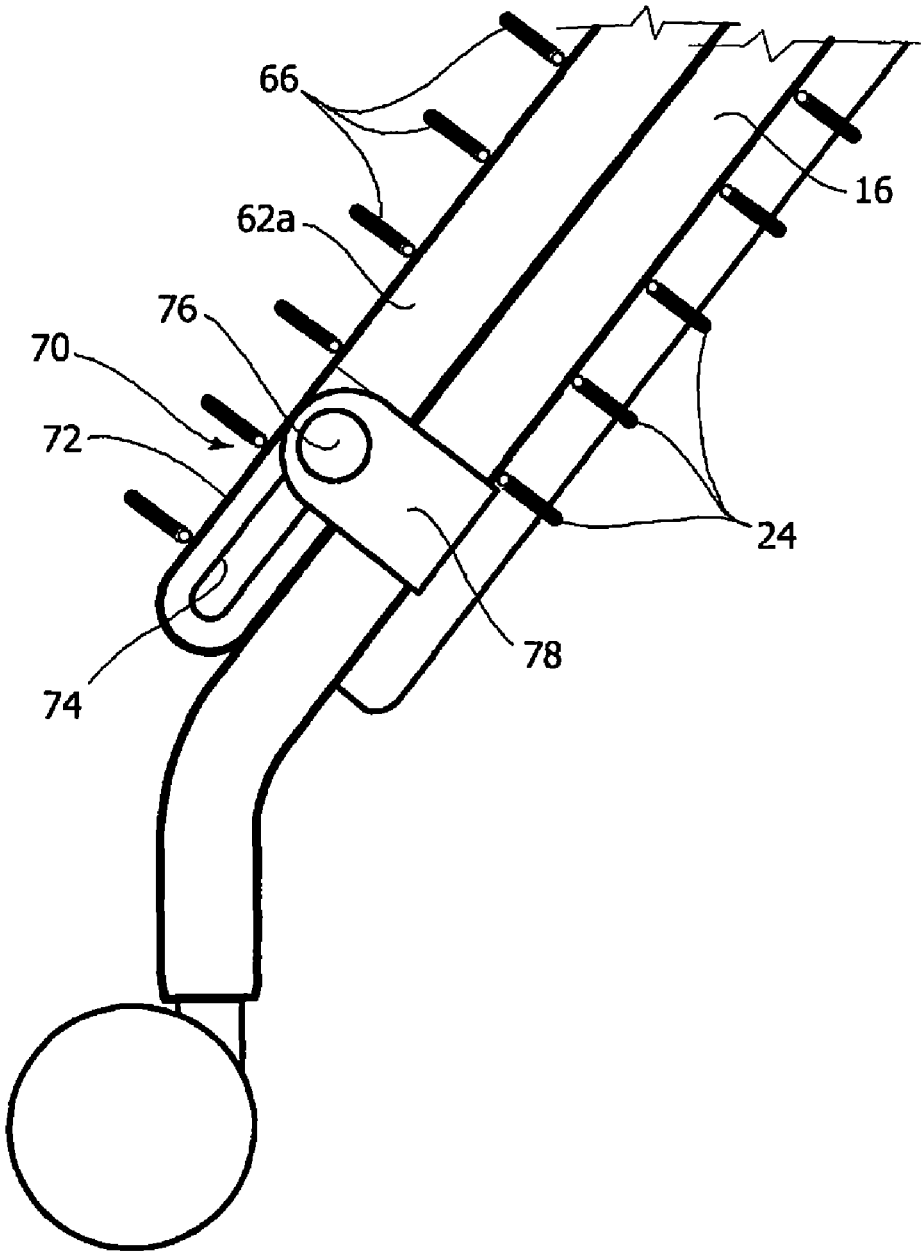
FIG. 10 is an enlarged scale side view of the detail indicated by the arrow X in FIG. 1, FIGS. 11 and 12 illustrate the sequence of motion of the movable support element of FIG. 10, FIGS. 13 and 14 are perspective views of a second embodiment of the convertible chair according to the present invention respectively in the chair and chaise-longue configuration.
Figure 11:
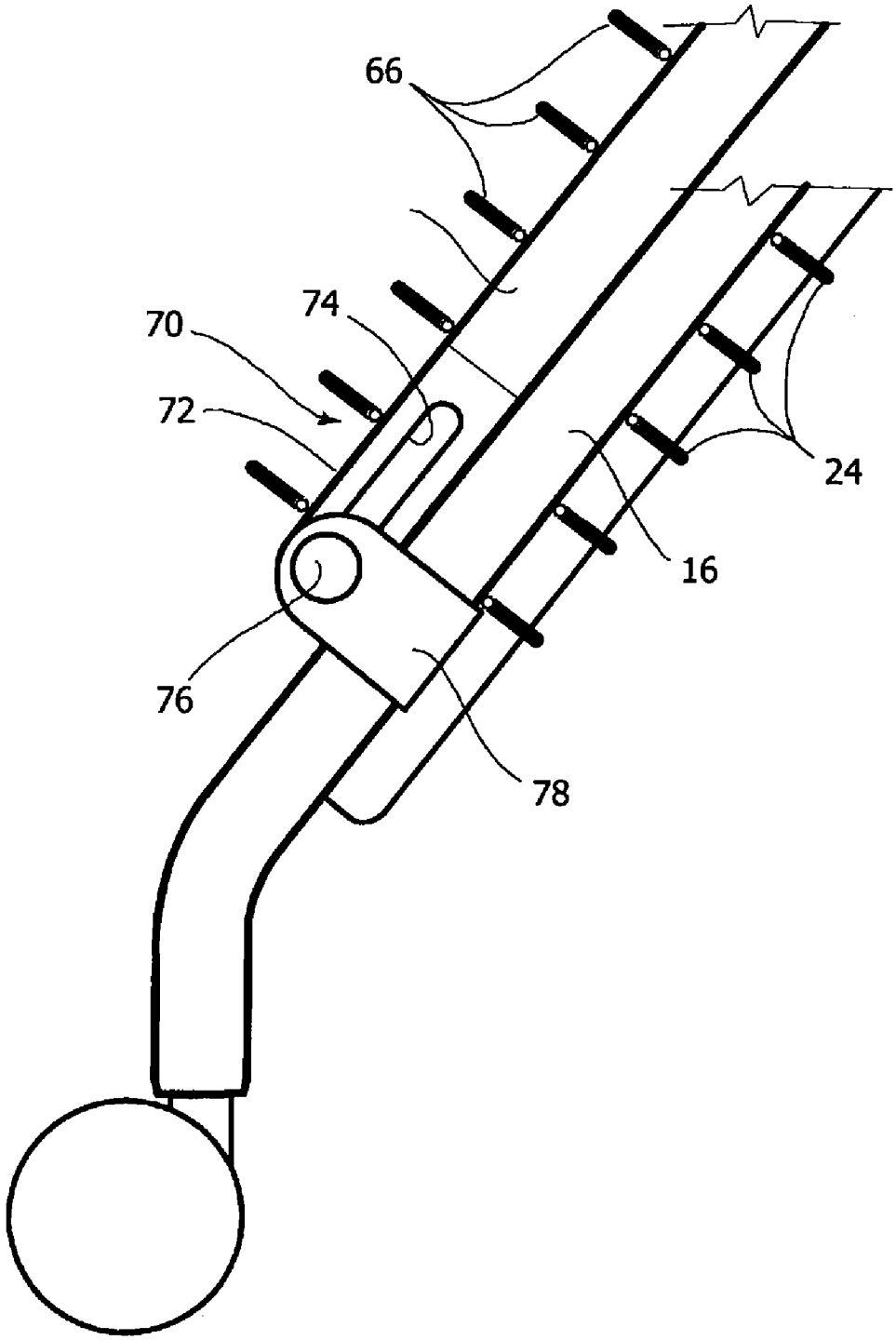
Figure 12:
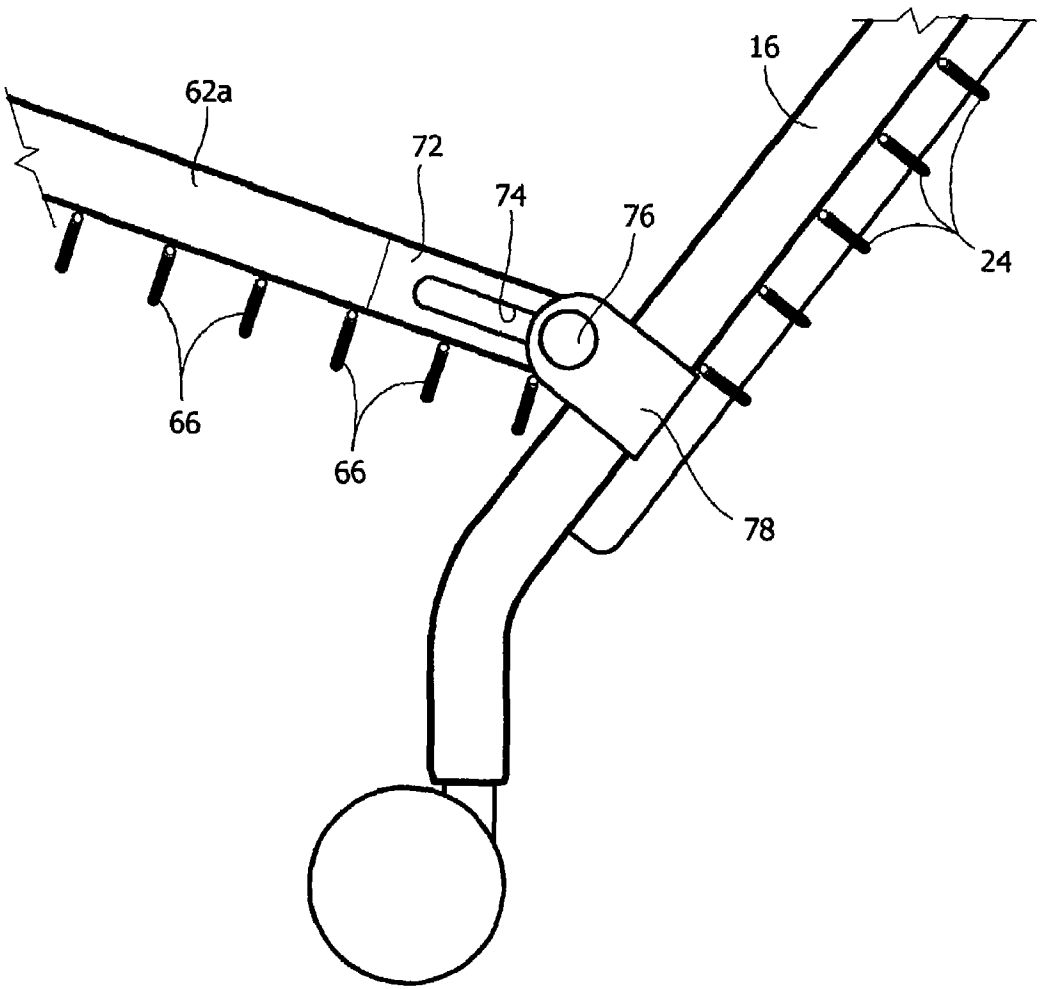

With reference in particular to FIGS. 10, 11 and 12, the movable support element 56 is connected to the stationary base structure 12 by means of two pivot and slit mechanisms 70. The lateral branches 62 of the movable support element 56 are connected to the branches 16 of the stationary support structure 14 at the lower end of the first support section 28. A connecting element 72 is fastened to the end of each of the two rectilinear segments 62*a* of the movable support element 56. The connecting element 72 has a slit 74 engaged by a pivot pin 76 fastened by means of a flange 78 to the respective branch 16 of the stationary base structure 12.

The pivot pin and slit mechanisms 70 enable the movement of the movable support element 56 with respect to the base structure 12 between the position shown in FIGS. 1, 3 and 10 (chair configuration) and the position shown in FIGS. 2, 4, 5 and 12 (chaise-longue configuration). With reference to FIGS. 10 through 12, to move from the chair position to the chaise-longue position, it is sufficient to move upwards the movable support element 56 until bringing the pivot pin 76 to abut against the lower end of the slit 74 (positions of FIG. 11). Once this position is reached, the movable support element 56 can rotate around the axes of the pivot pins 76 until the transverse element 64 bears down on the ground (position of FIG. 12).

Figure 4:
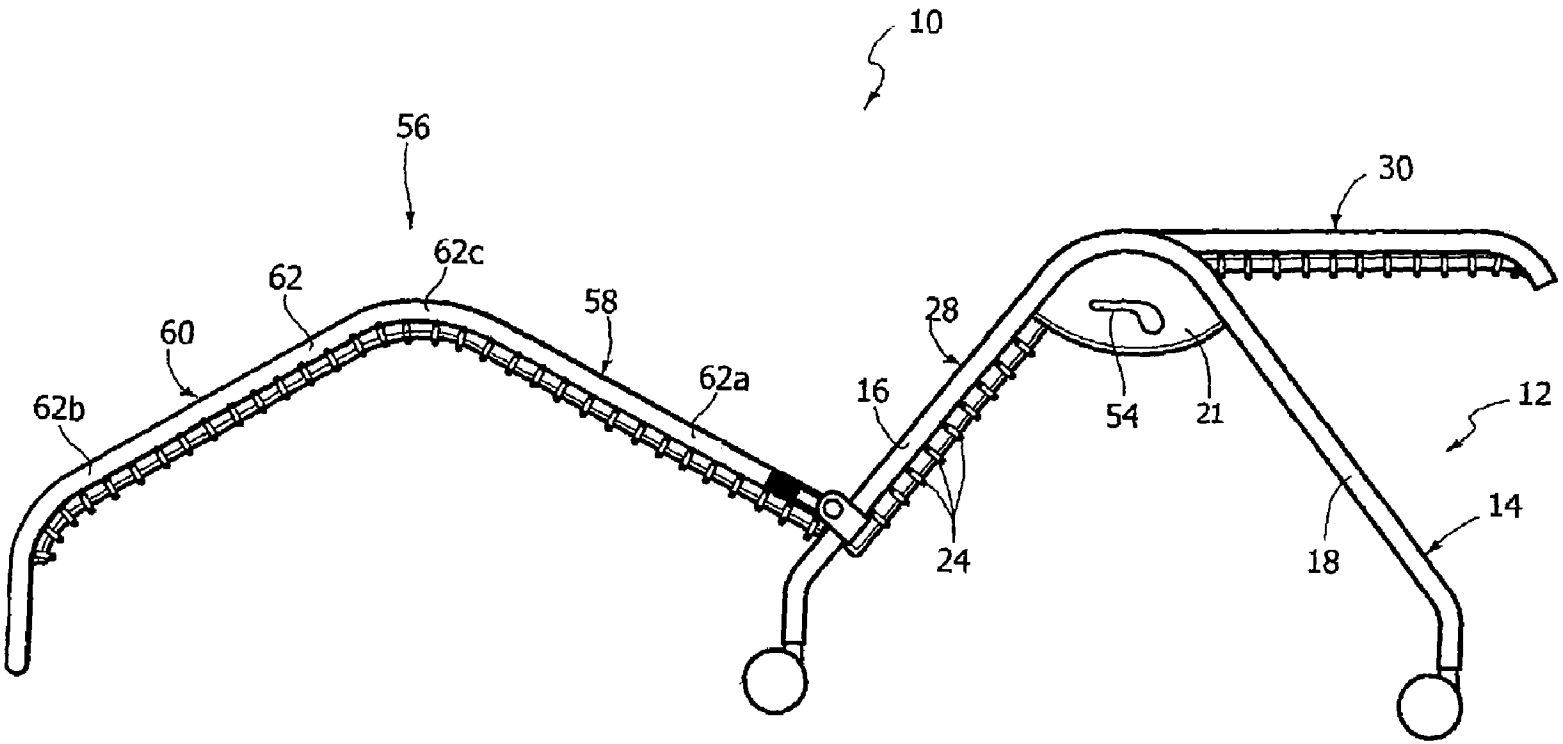

As an alternative to the pivot pin and slit devices, two hinges associated to one or two locking devices could be used. With reference to FIGS. 3, 4 and 5, in the chair configuration shown in FIG. 3 the second support section 30 extends in substantially horizontal position and forms the seat of the chair. The third support section 58 is parallel and opposite to the first support section 28. The fourth support section 60 extends upwards and backwards with respect to the first support section 30 and it forms the backrest of the chair.

To move to the chaise-longue configuration, the movable support element is rotated with respect to the stationary base structure as shown in FIG. 4. Then, the second support structure 30 is rotated upwards and locked in the raised position as shown in FIG. 5.

In the chaise-longue configuration shown in FIGS. 2 and 5, the first and the second support sections 28, 30 form a backrest, the third support section 58 forms an intermediate section to support the upper part of the legs and of the hips and the fourth support section 68 forms a support for the feet. The third support section 58 extends upwards starting from the lower end of the first support section 28 and the fourth support section 60 extends downwards starting from the upper end of the third support structure. The move from the chaise-longue configuration to the chair configuration is performed by repeating the previous operations in reverse fashion. The order with which the support elements are actuated is irrelevant.

In the embodiment described above, each of the support sections 28, 30, 58, 60 comprises a framework formed by thin metal rods, preferably with arched shape, and a padding element. In a variant of the present invention, the frameworks of the support sections could be eliminated. In this case, the padding element could be replaced by a flexible sheet anchored along its lateral edges to the frame elements 16, 32, 62. As an additional alternative, each support section 28, 30, 58, 60 could be provided with its own framework with related padding element, independent of the structure of the chair and able to be fastened to the frame element of the chair. As a further alternative, the metal rods 24, 34 and 66 could be replaced by tensioned elastic cables.

In this case, the padding layer could be eliminated because such cables would directly form the support surface.

Figure 13:
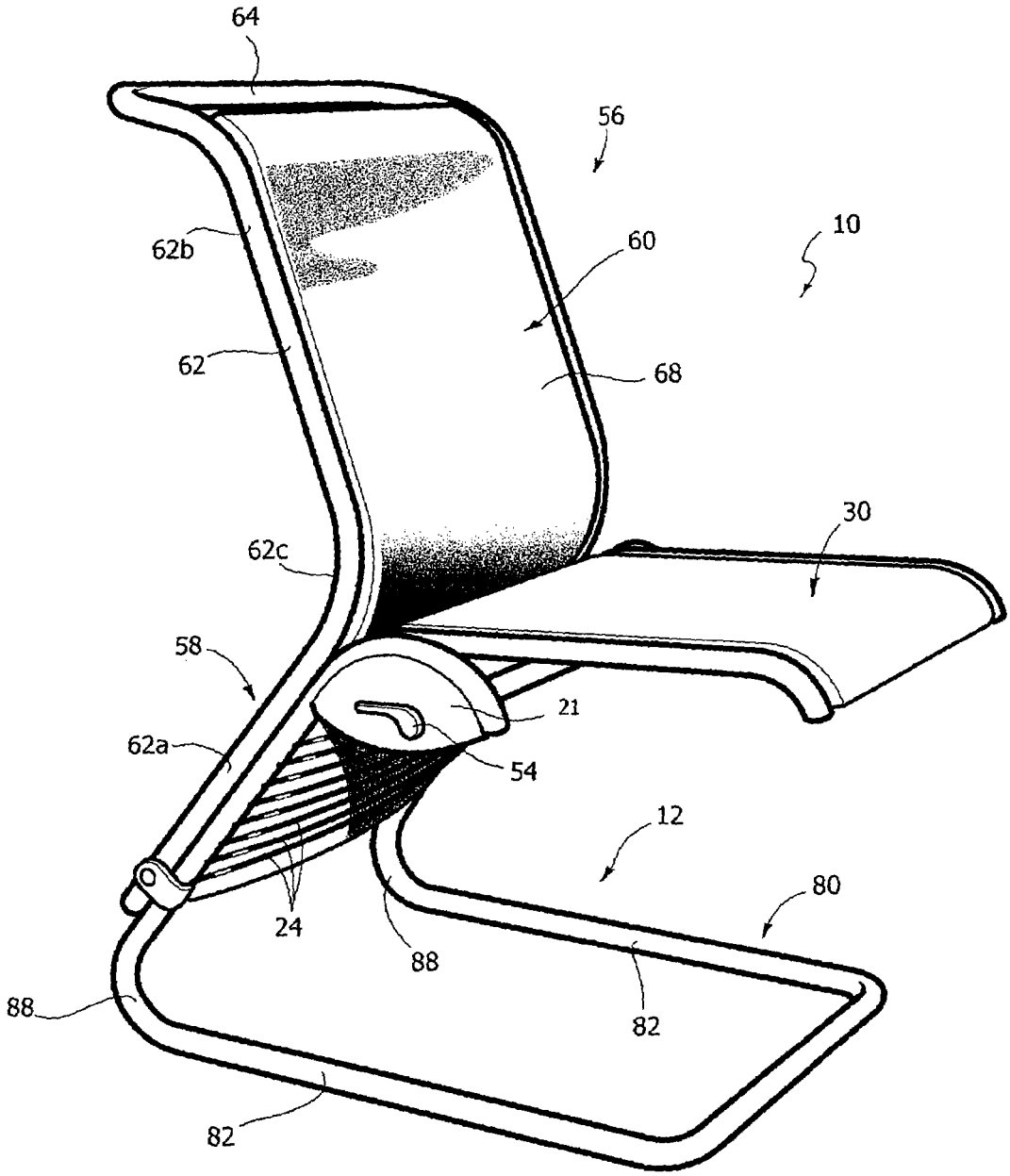
Figure 14:
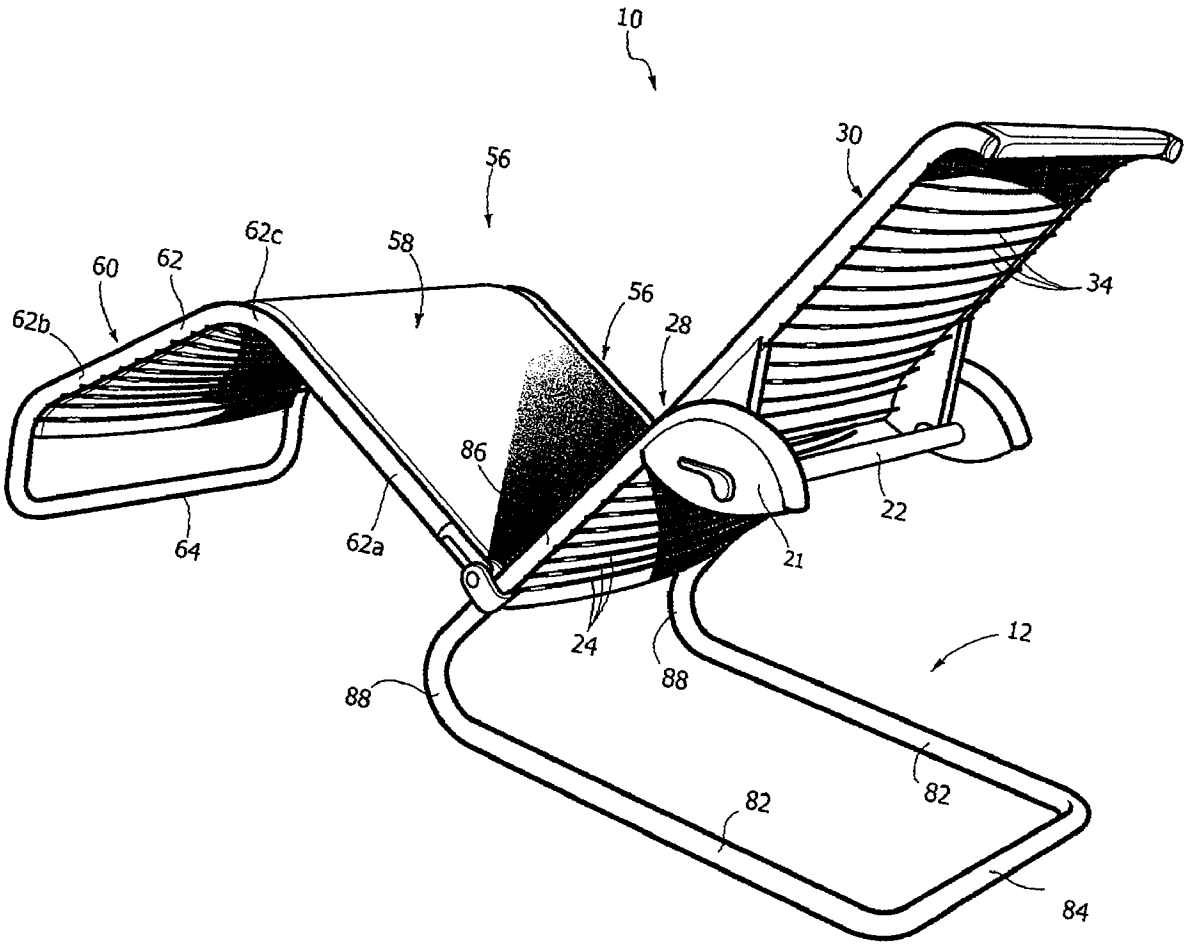

FIGS. 13 and 14 show a variant of a second embodiment of the convertible chair according to the present invention. The details corresponding to the previously described ones are designated by the same numeric references. In the first embodiment described previously, the stationary base structure is constructed in such a way as to form, in the chair configuration, a pair of rear legs and a pair of front legs which may be provided with wheels at their lower ends, as shown in the drawings. In the variant of FIGS. 13 and 14, the stationary base structure 12 comprises a tubular element 80 with two lower horizontal branches 82 connected to each other at their front ends by a transverse branch 84. The rear ends of the horizontal branches 82 are connected to respective inclined branches 86 by means of arched junction segments 88. The upper ends of the inclined branches 86 are arched and bear the plates 20 and the covers 21 as in the embodiment described previously. The remaining components of the convertible chair are identical to those described previously. In this variant of the invention, the "overhang" structure of the stationary base structure 12 provides a springing capability of the backrest 28, 30 in the chaise-longue configuration thanks to the elasticity of the junction portions 88.

Figure 15:
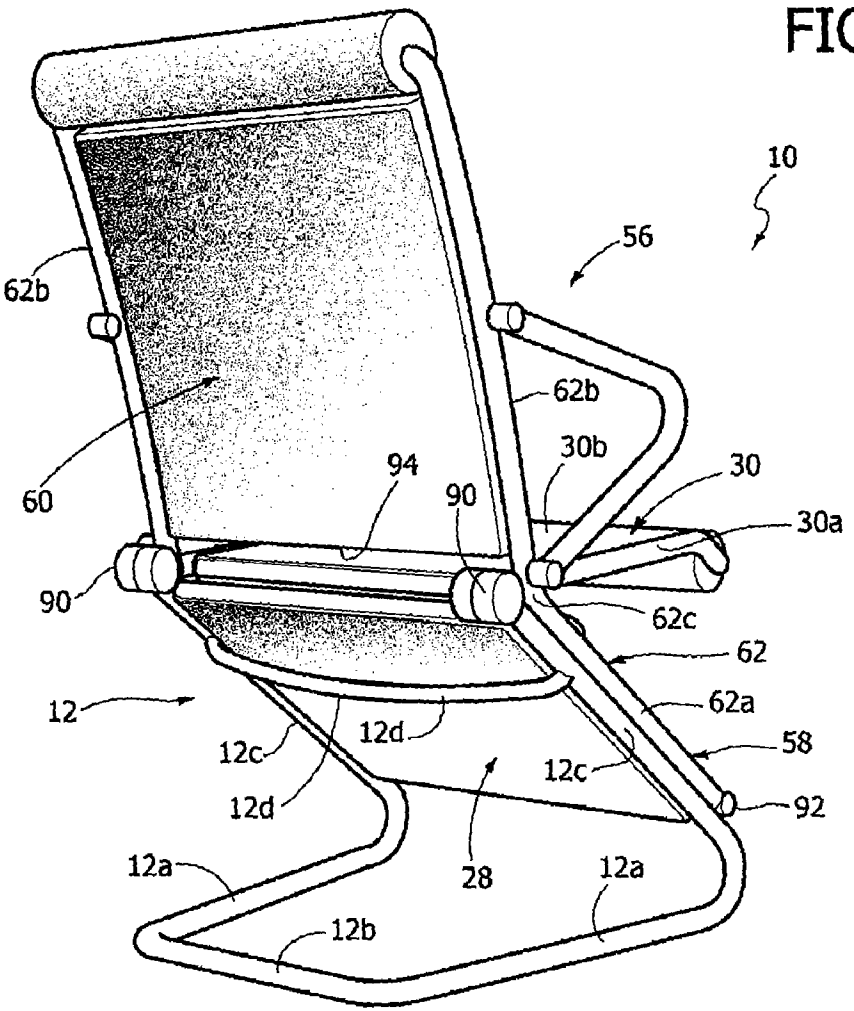
FIGS. 15 and 16 are perspective views of a third embodiment of the convertible chair according to the present invention respectively in the chair and chaise-longue configuration.
Figure 16:
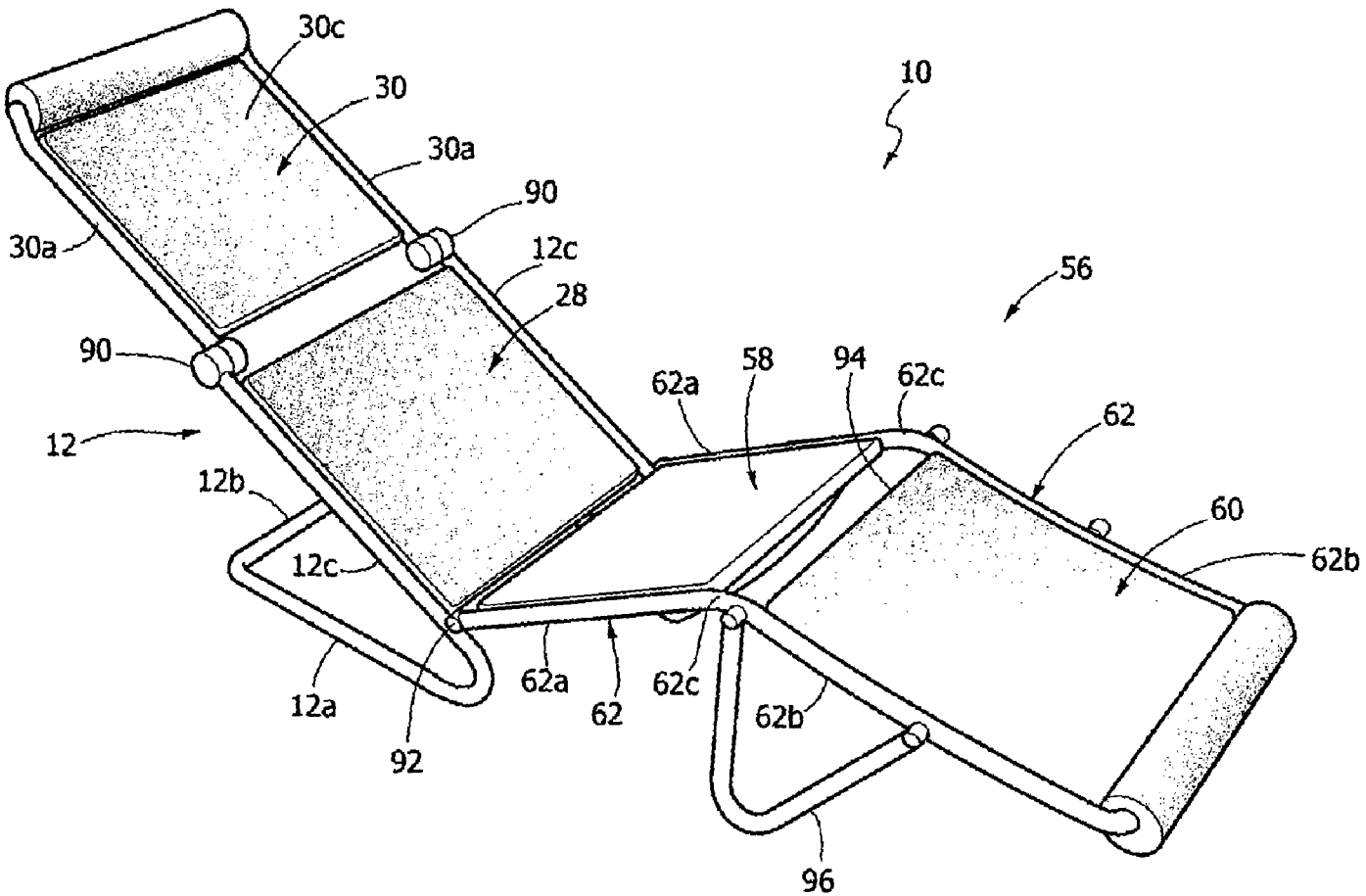

FIGS. 15 and 16 show a third second embodiment of the chair according to the invention. The details corresponding to those of the first embodiment are designated by the same numeric references.

The chair 10 according to this third embodiment comprises a stationary base 12 formed by one or more metallic tubular elements. The base 12 has two lower rectilinear horizontal branches 12*a* joined together at their rear ends by a transverse horizontal branch 12*b*. The front ends of the branches 12*a* are joined to two lateral branches 12*c* inclined upwards. The lower horizontal branches 12*a* mutually converge towards the rear part of the chair. The inclined branches 12*c* may be mutually joined by a transverse element 12*d*.

The first support section 28 is fastened to the inclined lateral branches 12*c* of the stationary base 12.

The second support section 30 is articulated at the top end of the inclined branches 12*c* of the stationary base 12. The second support section 30 comprises two lateral tubular elements 30*a* which bear a panel having a first support surface 30*b* and a second support surface 30*c*. The lateral tubular elements 30*a* of the second support section 30 are articulated to the inclined lateral elements 12*c* of the base 12 by means of hinges 90 provided with integrated stops which define to end stop positions of the second support surface 30 with respect to the base 12.

In the first end stop position, shown in FIG. 15, the second support section 30 extends in the horizontal direction above the inclined segments 12*c* of the base 12 and forms the seat of the chair, with the first support surface 30*b* oriented upwards.

In the second end stop position, shown in FIG. 16, the second support section 30 forms an upward extension of the first support surface 28, with the second support surface 30*c* oriented upwards.

The articulated connection between the second support section 30 and the base 12 is preferably provided with friction, in order to allow the second support section to remain in a stable position in any intermediate position between the two end stop positions.

The movable support element 56 bearing the third and the fourth support section 58, 60 is articulated to the front part of the base 12 around a horizontal axis positioned under the first bearing section 28. More precisely, the articulation of the movable support element 56 to the base 12 is obtained by means of two hinges 92 which articulate the two lateral elements 62 of the movable support element 56 to the inclined branches 12*c* of the base 12. The two hinges 92 are positioned on the front side of the inclined elements 12*c*.

The two support sections 58, 60 of the movable support element 56 have the adjacent edges distanced from each other to define a through window 94 whose function shall become readily apparent hereafter.

The movable support element 56 comprises two lateral supports 96, each of which is formed by a substantially V shaped tubular element, with the two ends fastened to the respective lateral element 62 of the movable support element 56.

The movable support element 56 can be moved between a raised position (FIG. 15) and a lowered position (FIG. 16). In the raised position, the third support section 58 is parallel to and faces the first support section 28 and the fourth support section 60 extends upwards starting from the third support section 58 and forms the backrest of the chair. In the raised position, the lateral supports 96 form the armrests of the chair. In the lowered position, the third support section 58 is inclined relative to the first support section 28 and extends upwards starting from a bottom end of the first support section 28 and the fourth support section 60 extends downwards starting from an upper end of the third support section 58. In the second position, the supports 96 serves as feet for the bearing of the movable support element on the ground.

FIGS. 17 through 20 illustrate the sequence of operations to transform the chair 20 according to the third embodiment of the invention into a chaise-longue.

Figure 17:
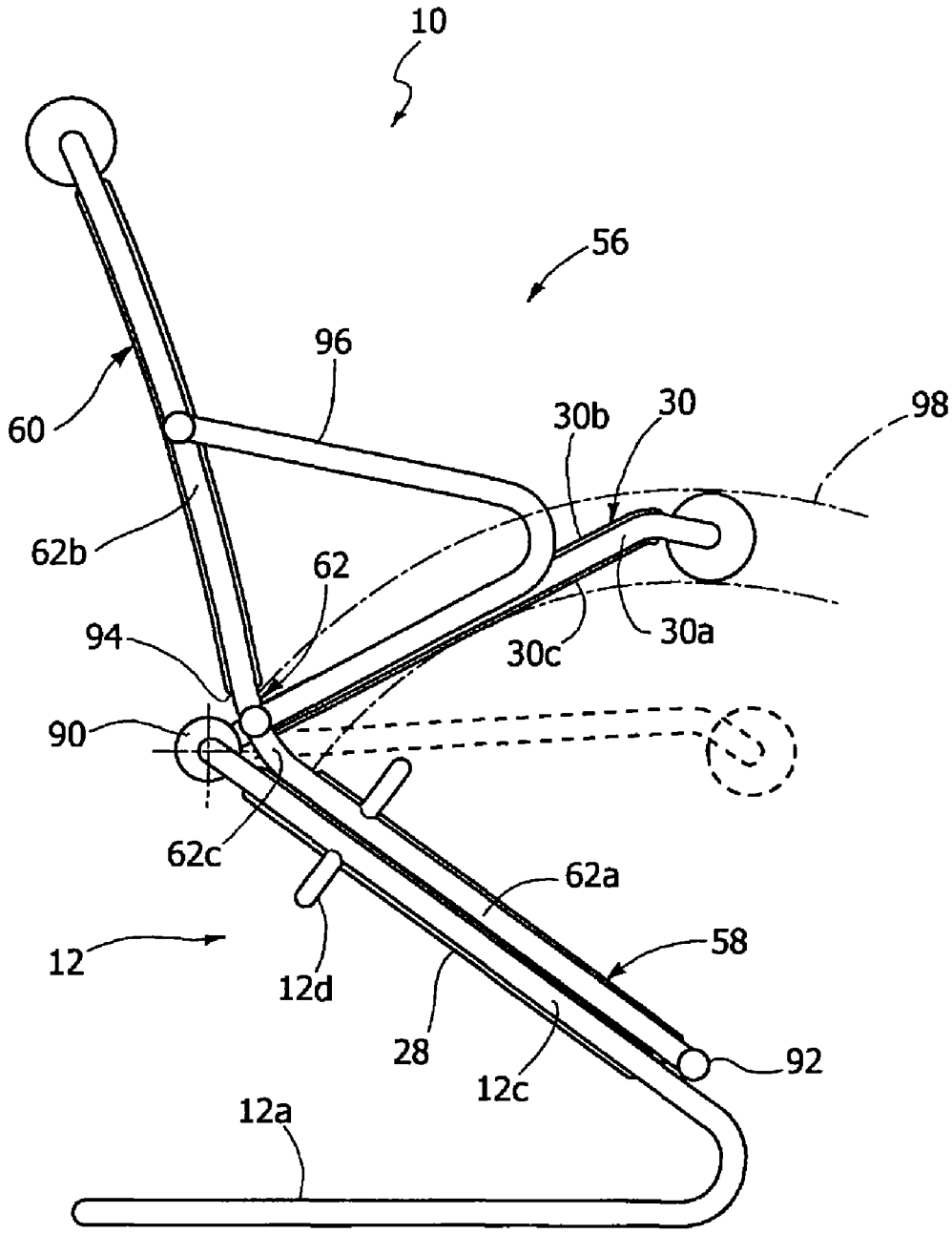
FIGS. 17-20 are schematic lateral views illustrating the sequence for converting the chair of FIG. 15 into chaise-longue.

With reference to FIG. 17, starting from the chair configuration, the second bearing section 30 (forming the seat in the chair configuration illustrated with dashed line) is brought to a predetermined slightly raised position, illustrated in solid lines in FIG. 17. The hinges 90 may be provided with a snap device which indicates to the user the correct position of the second support section 30.

Figure 18:
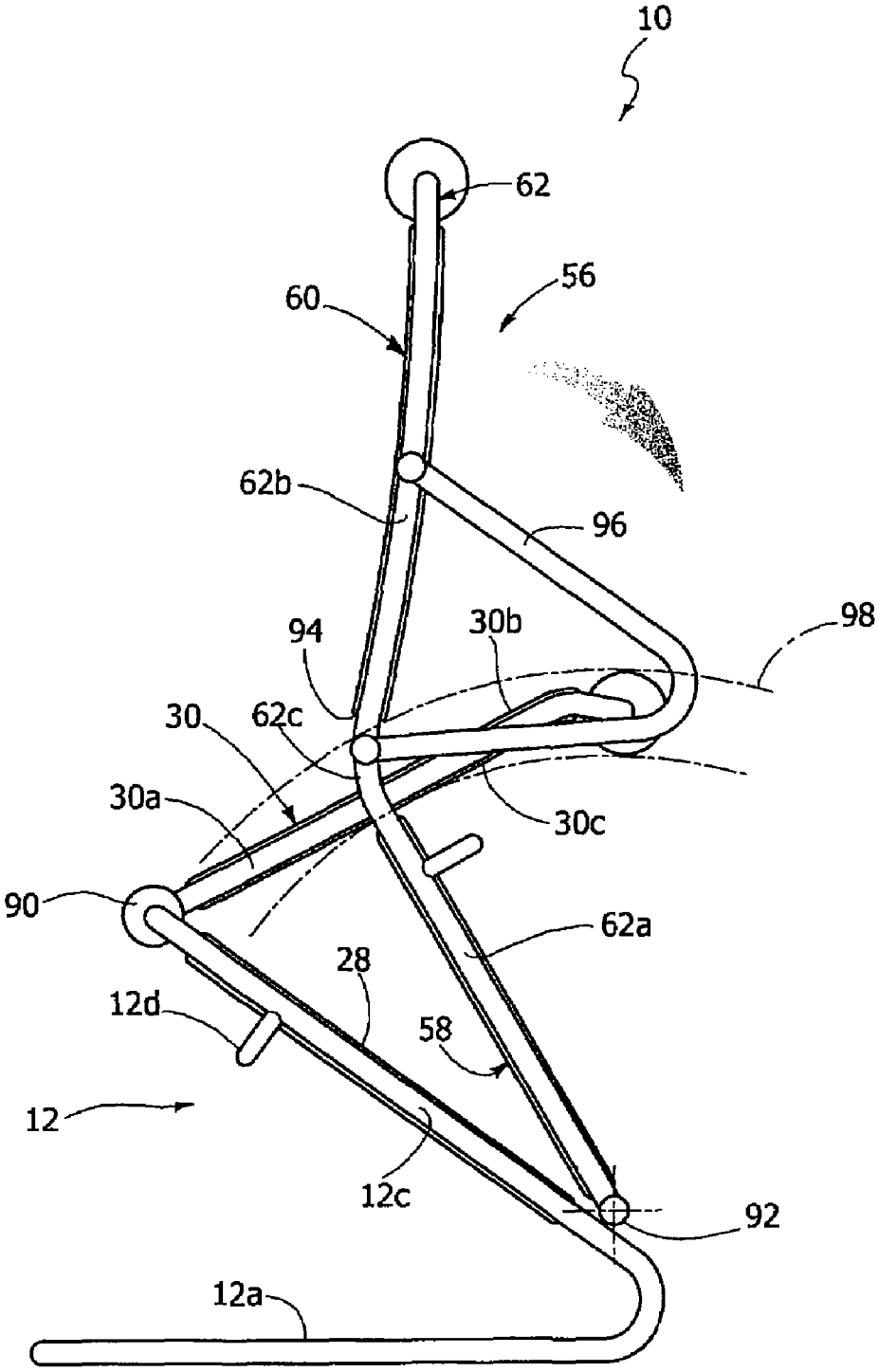

Hence, the movable support element 56 is made to rotate around the hinges 92 as shown in FIG. 18. In its slightly raised position, the second support section 30 is fully contained in the trajectory of the window 94, represented by the dashed lines designated by the reference number 98 in FIGS. 17-19.

Figure 19:
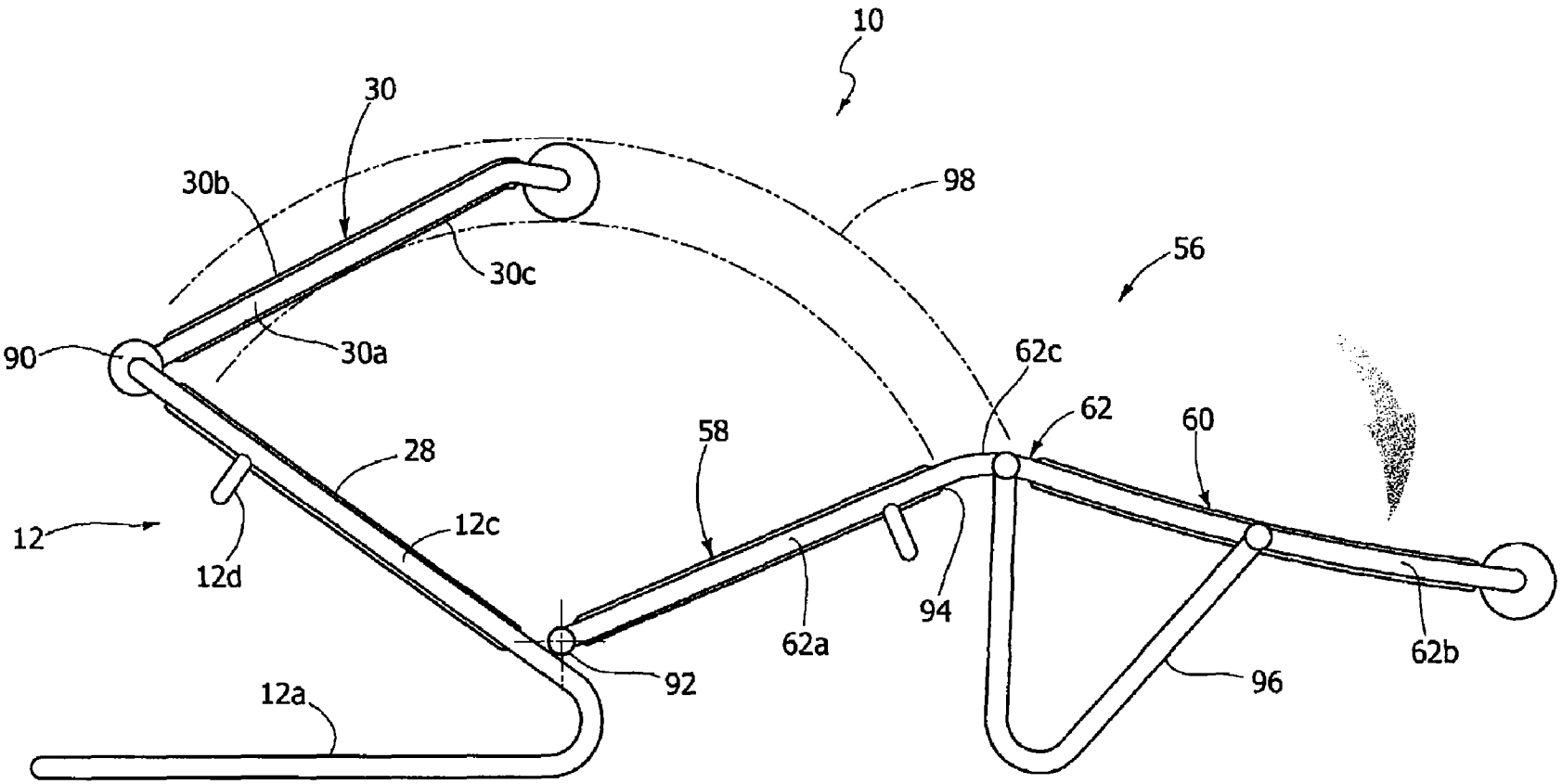
Figure 20:
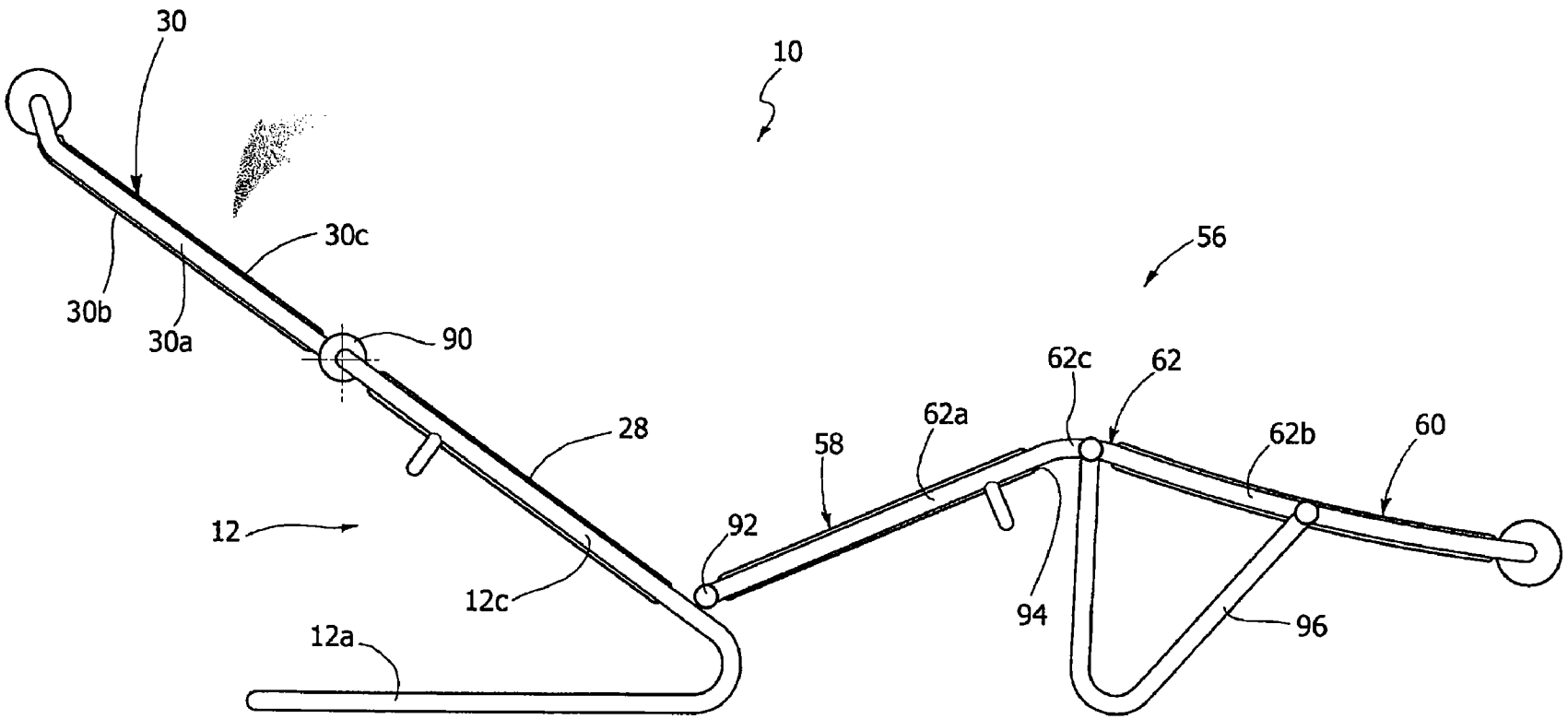

FIG. 19 shows the movable support element at the end of its rotation movement around the hinges 92, delimited by the bearing of the supports 96 on the ground. At this point, the second support section 30 is raised to its end stop position shown in FIG. 20, which shows the chair in the chaise-longue configuration.

To move from the chaise-longue configuration to the chair configuration, the sequence of motion described previously is followed in reverse order.

Figure 21:
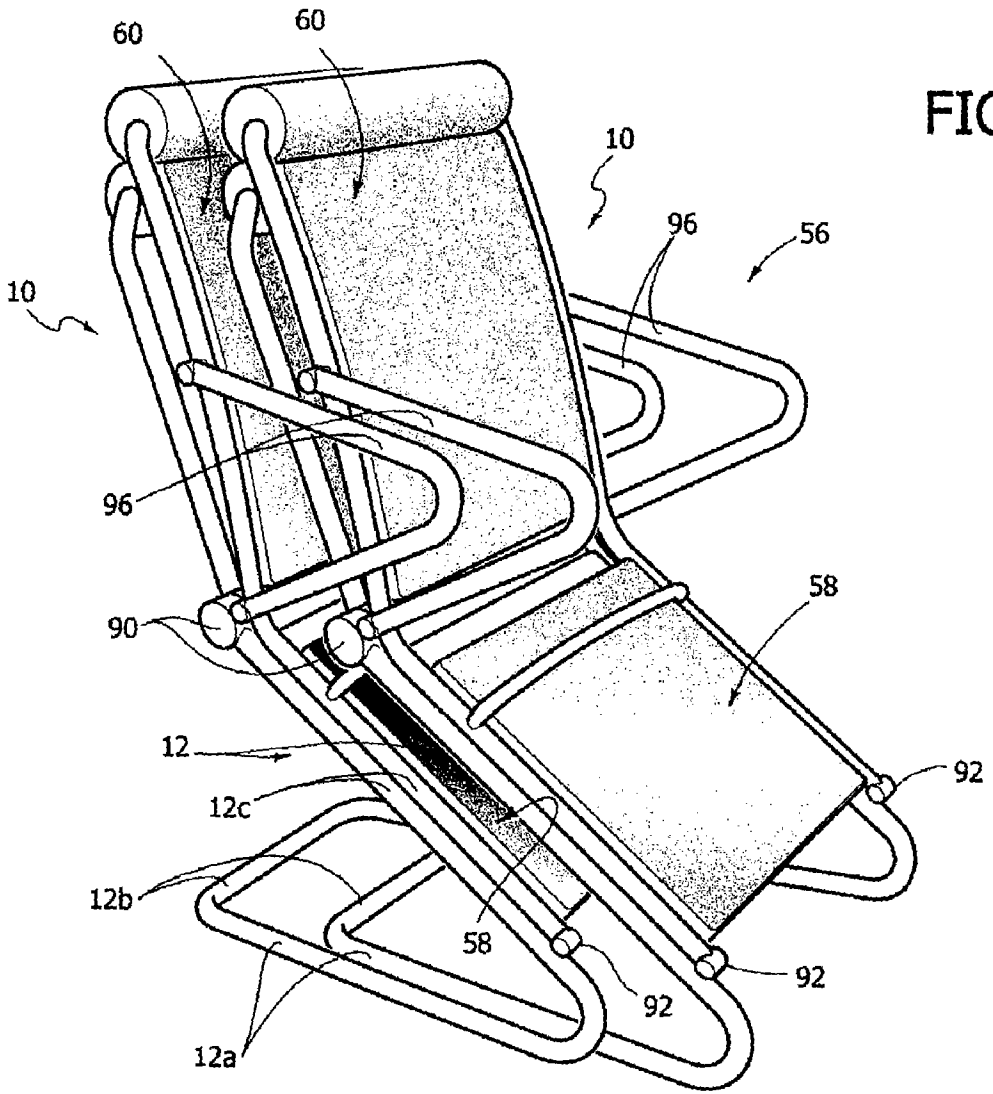
FIG. 21 is a perspective view showing two chairs according to the third embodiment of the invention in mutually nested position.

The chair according to the third embodiment of the present invention also allows to mutually nest two or more chairs of the same type. FIG. 21 shows two chairs 10, mutually nested.

To mutually nest two or more chairs as shown in FIG. 21, it is necessary to arrange the chairs in a nesting configuration which is obtained the following way. Starting from the chaise-longue configuration shown in FIG. 20, first the movable support element 56 is raised and then the second support section 30 is rotated until bringing the second support portion against the fourth support section. In this way, the second support section is positioned behind the fourth support section 60. In this configuration, the chairs can be mutually nested with a mutual approach in the longitudinal direction.

While the foregoing is directed to embodiments of the present invention, other and further embodiments of the invention may be devised without departing from the basic scope thereof, and the scope thereof is determined by the claims that follow.

The invention claimed is:

1. A chair convertible into chaise-longue, comprising:

a stationary base structure, a first support section, fixed relative to the base structure, a second support structure movable relative to the base structure and able to be moved from a substantially horizontal position to an inclined position in which the second support section forms an upward extension of the first support section, and a movable support element having a third and a fourth support section fixed relative to each other and mutually inclined, the movable support element being displaceable relative to the base structure between a first and a second position, wherein in the first position the third support section is parallel and opposite to the first support section and the fourth support section extends upwards starting from the third support section, and wherein in the second position the third support section is inclined relative to the first support section and extends upwards starting from a lower end of the first support section and the fourth support section extends downwards starting from an upper end of the third support section.

2. The convertible chair as claimed in claim 1, characterized in that the second support section is articulated to the stationary structure around a transverse axis, the base structure comprising a locking device to lock the second support section in its inclined position.

3. The convertible chair as claimed in claim 1, characterized in that the movable support element is connected to the stationary base structure by two pivot pin and slit mechanisms.

4. The convertible chair as claimed in claim 1, characterized in that the movable support element comprises a tubular frame with two lateral elements joined together by a transverse element, each of the two lateral elements having two rectilinear segments mutually inclined and joined by an arched segment.

5. The convertible chair as claimed in claim 1, characterized in that each of said support sections comprises a framework and a padding element.

6. The convertible chair as claimed in claim 5, characterized in that the framework of said support sections comprises a plurality of thin metal rods fastened to lateral tubular elements.

7. The convertible chair as claimed in claim 1, characterized in that each of said support sections comprises a flexible sheet without framework tensioned between lateral tubular elements.

8. The convertible chair as claimed in claim 1, characterized in that the stationary base structure comprises two lateral tubular elements each of which has substantially inverse V shape.

9. The convertible chair as claimed in claim 1, characterized in that the stationary base structure comprises a tubular element with two lower horizontal branches connected at their rear ends to two inclined branches.

10. The convertible chair as claimed in claim 1, characterized in that the stationary base structure comprises two inclined branches whereto is fastened the first support section.

11. The convertible chair as claimed in claim 10, characterized in that the second support section is articulated to an upper end of said inclined branches and in its horizontal position extends above said inclined branches.

12. The convertible chair as claimed in claim 10, characterized in that the movable support element is articulated to a front part of the base structure around a horizontal axis positioned below the first support section.

13. The convertible chair as claimed in claim 12, characterized in that the movable support element has a through window defined between the third and the fourth support sections.

14. The convertible chair as claimed in claim 13, characterized in that during the displacement of the movable support element from the first to the second position, the second support section extends through said window.

15. The convertible chair as claimed in claim 10, characterized in that the movable support element is provided with two lateral supports which in the first position of the movable support element form two armrests of the chair and in the second position of the movable support element serve as feet for bearing on a ground.

16. The convertible chair as claimed in claim 10, characterized in that during the chair can assume a nesting configuration in which the movable support element is in its first position and the second support section is situated behind the fourth support section.

17. The convertible chair as claimed in claim 16, characterized in that in the aforesaid nesting position the chair can be nested with a chair of the same kind by approaching them in a longitudinal direction.

* * * * *

UNITED STATES PATENT AND TRADEMARK OFFICE

CERTIFICATE OF CORRECTION

PATENT NO. : 7,387,332 B2
APPLICATION NO. : 11/423549
DATED : June 17, 2008
INVENTOR(S) : Piretti It is certified that error appears in the above-identified patent and that said Letters Patent is hereby corrected as shown below:

In the Claims:

Column 8, Claim 16, Line 39, please delete "during".

Signed and Sealed this

Tenth Day of February, 2009

JOHN DOLL
*Acting Director of the United States Patent and Trademark Office*